US005315661A

United States Patent [19]

Gossman et al.

[11] Patent Number: 5,315,661

[45] Date of Patent: May 24, 1994

[54] ACTIVE HIGH TRANSMISSION LOSS PANEL

[75] Inventors: William Gossman, Silver Spring, Md.; Graham Eatwell, Cambridge, United Kingdom

[73] Assignee: Noise Cancellation Technologies, Inc., Linthicum, Md.

[21] Appl. No.: 928,472

[22] Filed: Aug. 12, 1992

[51] Int. Cl.[5] ..... G10K 11/16

[52] U.S. Cl. ..... 381/71

[58] Field of Search ..... 381/71, 94

[56] References Cited

U.S. PATENT DOCUMENTS

| | | | |
|---|---|---|---|
| 4,025,724 | 5/1977 | Davidson, Jr. et al. . | |
| 4,715,559 | 12/1987 | Fuller . | |
| 4,878,188 | 10/1989 | Gossman | 364/724.01 |
| 4,987,598 | 1/1991 | Eriksson | 381/71 |
| 5,091,953 | 2/1992 | Tretter | 381/71 |

OTHER PUBLICATIONS

Waraka, "Active Attenuation of Noise-The State of the Art", Noise Engineering Control, May-Jun. 1982, pp. 100-110.

"Cancelling Transformer Noise", Electrical Review, vol. 209, No. 4, Jul. 24/31, 1981.

"Piezo Actuators for Distributed Vibration Excitation of Thin Plates" Dimitnadis et al, Journal of vibration and Acoustics vol. 113 pp. 100-107, Jan. 1991.

"Experiments on Active Control Structurally Radiated Sound Using Multiple Piezoceramic Actuators in Active Structural Acoustic Approaches" Journal of Acoustical Society of America 88 S1 S147 Chris Fuller, Fall 1990.

*Primary Examiner*—Forester W. Isen

*Attorney, Agent, or Firm*—James W. Hiney

[57] ABSTRACT

An active high transmission loss panel for quieting either one or two way sound radiation which incorporates a number of cells (11) which contain sensors and actuators (12) adapted to be controlled independently or interactively so as to attenuate noise attempting to pass through said panel.

17 Claims, 1 Drawing Sheet

ACTIVE HIGH TRANSMISSION LOSS PANEL

The subject invention identifies an apparatus and method for controlling sound transmission through (from) a panel using sensors, actuators and an active control system. The method uses active structural acoustic control to control sound transmission through a number of smaller panel "cells" which are in turn combined to create a larger panel. The invention is a replacement for thick and heavy passive sound isolation material, or anechoic material.

BACKGROUND

This invention expands on the theory of active structural acoustic control as in U.S. Pat. No. 4,715,559 to Fuller. The Fuller patent teaches the art of controlling sound by controlling the efficiently radiating modes of a structure. Additionally, the theory of utilizing PVDF sensors is used in the invention.

Previous attempts at controlling large sound fields exist in many variations. Attempts by Jessel ("Secondary sources and their energy transfer," Acoustics Letters 4 (1981) 174–179) using control surfaces defined by planar arrays of microphones and speakers show an attempt at control from a non-compact source. Additionally, Davidson, Jr. et al. (U.S. Pat. No. 4,025,724) teach a method by which noise from non-compact sources can be controlled using a planar array of acoustic projectors and sensors.

A specific problem of a non-compact noise source which various people have tried to address is controlling the sound of a power generation transformer. This problem represents a non-compact noise source, and thus is useful to evaluate previous methods of non-compact noise source control. The creation of a sound barrier around a transformer is by no means unique. The principles described can be used in relation to the control of sound from other non-compact sources.

The control of transformer radiated noise is a problem whose satisfactory solution still remains to be found. Larger transformers consist of various configurations of metallic laminated cores and electrical windings immersed in an oil bath. The oil volume is usually contained in tank designed as a rectangular-like outer enclosure. Due to the magnetostrictive nature of the electrical excitation the excitation of the core appears as a sinusoid at twice the mains frequency plus harmonics. The winding and core are excited by the fluctuating magnetic force. These excite the oil field which in turn excites the outer casing. The outer casing then radiates sound. Due to the nature of the excitation the noise field is generally very tonal with peaks at the fundamental (twice the mains frequency) and harmonics. The noise fundamental is fairly low in frequency being around 100 Hz, and is thus difficult to control by passive means such as damping, stiffeners, etc. Furthermore, due to its long wavelength (of the order of 3.3 meters) the noise tends to diffract around barriers (such as beams, shields, etc.) located to control the sound.

Possibly one of the earliest attempts to actively control sound from transformers was described by Conover in *Noise Control*, Vol. 92, pp 78–82, "Fighting Noise with Noise", 1956. Conover experimentally investigated the use of acoustic sources arranged around a 150 MVA transformer close to its surface. The active acoustic sources in this case consisted of large loud speakers whose input was a control signal with adjustable amplitude and phase. Conover demonstrated that large attenuations of radiated sound could be achieved in the far-field. However, the attenuations were limited to selected angles and at other angles the sound was increased in magnitude. This result is undoubtedly due to the large size of the transformer relative to wavelength of the sound. The transformer cannot be considered as a compact source when its characteristic dimensions are greater than an acoustic wavelength, and thus its noise field cannot be globally controlled with a low number of control acoustic sources.

The next interesting work was carried out by Hesselman who looked at active control of sound radiation from a far smaller, 100 kVA transformer. In this arrangement two loudspeakers were used located at either end of the transformer. The residual or controlled noise field had the characteristic of a longitudinal quadrapole which has a very low radiation efficiency at low frequencies. Hesselman also employed a control system for the first time that was essentially feed-forward. The second harmonic of the mains signal was used to trigger a signal generator. The output of the signal generator was passed through a multi-channel phase shifter and amplifier and then to the compensation (active) acoustic sources. The amplitude and phases of the compensation signal were adjusted so as to provide a control field very close to the noise field at the measurement points in the far-field. Once adjusted the phase to the compensation speakers was flipped through 180 degrees and the residual field measured. All experiments were performed in an anechoic chamber. It should also be noted that the noise field was dominated by the fundamental by 20 dB over the harmonics.

These results demonstrate global attenuation of the order of 20–40 dB depending upon observation angle. An additional interesting result was that the sound levels rose in the transformer near-field while they were attenuated in the far-field.

As discussed by Hesselman the global control exhibited in his tests are due to the small size of the transformer (approximately 2 m×1 m×1 m) relative to the wavelength (approximately 3.3 m). This is apparent in the noise field of the transformer studied by Hesselman which exhibits the omni-directional, monopole directivity radiation pattern associated with a compact source unlike the case studied by Conover. Hesselman also points out that in the application of the active technique to a large transformer, the noise source can be considered as being composed of a number of locally compact sources whose linear dimensions do not exceed one third of a wavelength. Each of these sub-sources can then be thought of as a compact or monopole source of a particular source strength and phase. This type of arrangement may be then controlled by the use of a set of active acoustic sources, independently controlled, positioned over and very near the center of each subpanel. The active sources would have opposite phase and the same source strength as their associated subpanel. Hesselman thus foreshadowed the use of "arrays" of acoustic sources as used by his later counterparts.

Experiments of the use of "arrays" were carried out by Angevine who described his work in *Proceedings of Inter-Noise* 81, pp 303–306, "Active Acoustic Attenuation of Electronic Transformer Noise", 1978. Angevine studied active control of transformer noise using arrays of sound sources arranged around the transformer. His results generally support what is stated above. If the transformer physical size is large compared to the acoustic wavelength then arrays of many acoustic sources arranged around the transformer will be needed to proved global control. Otherwise attenuation will be achieved at selected radiation angles towards error microphones but increase towards other radiation angles (control spillover).

The work of Ross is described in *Journal of Sound and Vibration*, Vol. 61(4), pp 473–476, "Experiments on the Active Control of Transformer Noise", 1978. Ross's work investigated active control of transformer radiated noise in a realistic application. In this situation two noisy transformers were located across a courtyard from offices in which the transformer noise was extremely annoying. The active control was realized by using a loudspeaker located near the transformer. Investigation of the noise field showed that it was relatively uniform when it reached the offices suggesting that the noise source was acoustically compact. For the active compensation, sound was picked up by a detector microphone and fed through a set of filter networks corresponding to the fundamental and first two harmonics (100, 200, 300 Hz). The output of these phase and amplitude controlled signals were then summed and fed into the active loudspeaker. With the loudspeaker in a variety of positions the system phases and amplitude was adjusted to minimize the noise at a number of positions in the offices.

The results showed that for the lowest frequency of 100 Hz the sound was reasonably globally controlled by between 10 to 28 dB throughout the office room. The higher frequencies of 200 and 300 Hz could only be controlled locally in areas of approximately 1 meter radius around the error microphones. Ross concludes, as with the previous work, that by "using more loudspeakers the control could be greatly improved."

The work of Eatwell is described in the Proceeding of the Institute of Acoustics, 9(7) pp. 269–274, "The Active Control of Transformer Noise,"1987. This work describes the results of computer optimizations for the positions of the control actuators for a 0.5 MVA transformer. The results demonstrate that the number of actuators required is proportional to the square of the frequency to be controlled.

The above work can be summarized as follows. When the transformer is compact relative to the wavelength of the noise then a low number of active acoustic sources will be required. A compact source is usually indicated by a relatively uniform radiation field with angle, around the transformer. When the transformer's dimensions are of the order of the wavelength, the radiation field exhibits complex lobes and arrays of acoustic sources arranged around the transformer at the center of areas of approximately lamda/3×lamda/3 in size will be needed where lamda is the acoustic wavelength. Systems such as this can be implemented, however, there are a number of practical disadvantages, amongst which are the high number of control channels needed. However, it is probably the sheer size and bulkiness of the active acoustic sources arranged around the transformer that has prevented their use. It is in this sense that the active acoustic panel solves the problem. In summary, the active panel provides a compact method to introduce the degrees of freedom necessary to control the non-compact acoustic source.

GENERAL DESCRIPTION

It has been demonstrated that sound radiated by vibrating structures can be controlled by point force inputs applied to the structure. However the use of shakers as control inputs has a number of disadvantages amongst which are size, space requirements and the need for back reaction support. Thus, recent work has been concerned with investigations on the use of piezoceramic elements as control actuators. Preliminary work revealed that piezoceramic patches when bonded to the surface of panels effectively act as a line moment around the edge of the patch. Dimitnadis et al describe this in Journal of Vibration and Acoustics, Vol. 113, pp 100–107, "Piezoelectric Actuators for Distributed Vibration Excitation of Thin Plates". The size, shape and location of the patch was demonstrated to affect the modal control field as well as the residual modal distribution. The magnitude of the input moment was dominantly dependent on the piezoceramic patch size, thickness, dielectric constant and limiting voltage.

Experiments were performed which conclusively proved that arrays of piezoceramic actuators could be used in conjunction with an adaptive controller to reduce sound radiation from harmonically vibrating panels. In these experiments up to three control channels were used and found to provide global reduction of the order of 15–20 dB both on and off resonance of the structural system. The steel panel dimensions in these tests was of 380 mm×300 mm and of two thicknesses (2 mm and 10 mm). Fuller et al, in the *Journal of Acoustical Society of America* 88(S1), S147, "Experiments on Active Control of Structurally Radiated Sound using Multiple Piezoceramic Actuators", and in the same publication, 88 (s1), S148, "An Experimental Study of the Use of PVDF Piezoelectric Sensors in Active Structural Acoustic Approaches", 1990, describe experiments which have also been performed in which the error microphones located in the radiation field (points at which acoustic field is minimized) are replaced by piezoelectric shaped sensors (manufactured from PVDF) attached directly to the panel surface. The sensors are shaped to act as wavenumber filters. If the sensors are long relative to the panel dimensions then they tend to average out short wavelength, high wavenumber subsonic structural vibration components. However, the sensors retain information from low wavenumber, long wavelength, supersonic structural components. As is well known, only the supersonic structural components radiate sound to the far-field and the structural shaped sensor thus only observe vibration components associated with far-field radiation. Experiments performed on the same panels as previously demonstrated show that the use of the PVDF sensors resulted in 10–15 dB global reduction of radiated sound pressure both on or off resonance. Optimizing the sensors location has led to even greater attenuations.

It should be noted that just minimizing structural response at various points using (for example) accelerometers often leads to increased sound radiation due to control spillover. It is important to observe and control only those structural motions which are significant radiators of sound to the far-field. Fuller et al described this in the Proceedings of American Control Conference, Pittsburgh, Pa., pp 2079–2089, "Experiments on Structural Control of Sound Transmitted Through an Electric Plate", 1989.

The object of the high TL panel is to create a thin and lightweight sound barrier, combining active and passive noise reduction use in controlling sound radiation from non-compact sources as well as sound transmission through walls, doors, etc. This technique is intended to replace thick and heavy passive sound insulation materials currently in use as architectural acoustic treatments as well as passive enclosure walls. Additionally, the technique will overcome the limitations organic to the prior art (which uses loudspeakers) such as size and weight. Additionally, the active high transmission loss panel combines both active and passive means to control noise. The prior art active control techniques do not integrate active and passive techniques.

Another object of this invention is to increase the frequency range of sound control through the use of a double leaf partition. This increases the advance time available to the control system and thus allows for the control of broadband noise using a feed-forward control technique.

Another object of this invention is to allow the control of sound passing in both directions through the panel.

These and other objects will become apparent when reference is had to the accompanying drawings in which.

Figure 2:
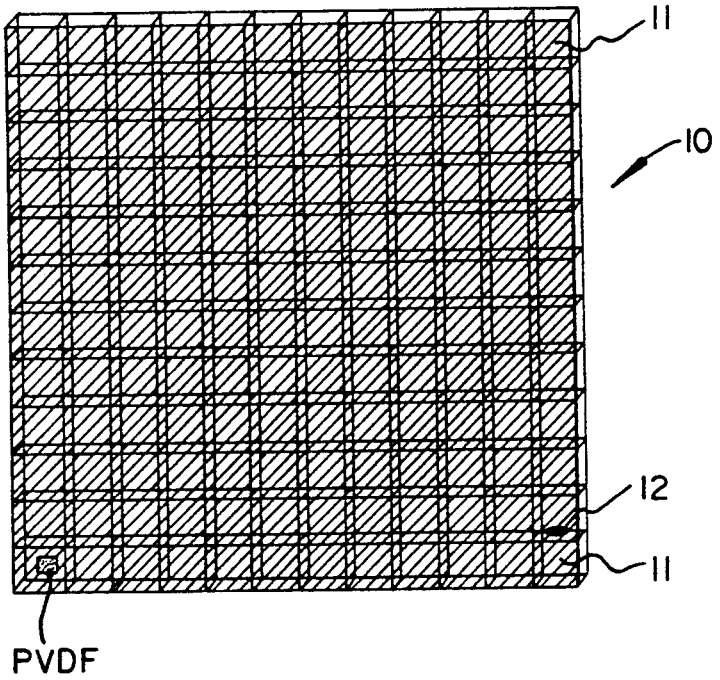
FIG. 2 shows a high transmission loss panel.
Figure 1:
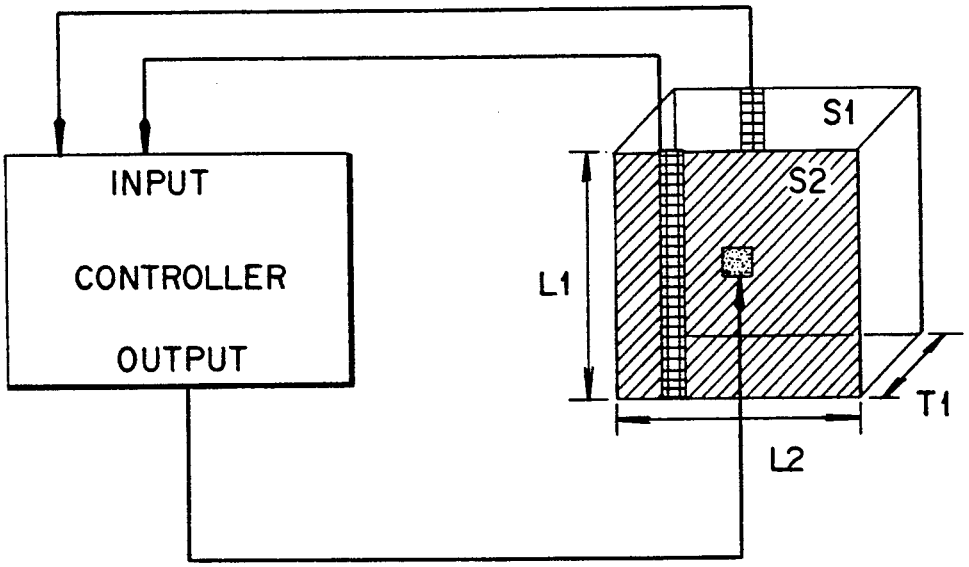
FIG. 1 shows a diagrammatic view of the system of this invention.

The subject invention is an answer to the problem of providing enough control degrees of freedom to globally cancel sound radiation from large structures. The method entails providing a barrier in front of a noise source, or, making a wall from the active panel, in which case, the wall becomes the "source" as well as the control means. FIG. 2 is a drawing of an active panel 10. The panel is comprised of a number of small "cells" 11 consisting of two partition leaves, each with a PVDF (or other) sensor, and an actuator 12 on (at leaset) one of the leaves. Note that this configuration is for sound traveling in one direction. With the addition of an actuator on the other leaf and a different control system, the panel could be made to control transmission loss in two directions. The cells may be hollow or contain well known sound absorbing materials to aid in eliminating the noise.

PANEL CONFIGURATION

The dimensions of the cell depend on the frequency content of the offending noise as well as the type of control system used and the delay properties of the sensor and actuator. L1 and L2 are typically of the same length, and correspond to less than $\frac{1}{3}$ of the acoustic wavelength of the highest frequency to be actively controlled. The upper limit of this frequency depends on the disturbance of interest as well as the high frequency passive isolation characteristics of the panel. For example, if a panel is designed to actively control up to 300 Hz, L1 and L2 would be approximately 0.25 to 0.3 meters. A standard $4' \times 8'$ panel can be made up of approximately 32 cells, 1' on a side.

T1 depends on the group delay of the system and the frequency of the disturbance. It is desirable to make T1 small (much smaller than L1) so that the wave propagation from S1 to S2 is planar. It is desirable to have a very small group delay in the system so that the control system can react to the disturbance as it propagates from S1 to S2.

The use of two leaves provide some minimal advance time to allow control of higher frequency, and broadband sound (as compared to the use of a single leaf).

SENSORS AND ACTUATORS

The sensors used in the active panel system are shaped and attached to detect the efficiently radiating structural modes of each respective cell within the panel. The actuator must be positioned to control the efficiently radiating modes of the panel to which it is attached. The sensors and actuators must also have very small delays so as to give the control system a large bandwidth. The piezoceramic actuators and PVDF sensors described above are the preferred sensor and actuator for the system.

CONTROL SYSTEM

Several types of control can be used in this configuration of the panel. Given that the transfer function (probably) does not change much over time, a fixed analog controller could be used to minimize the controller's response time and thus minimize T1. An adaptive feed-forward controller could also be used. Controllers described in U.S. Pat. Nos. 4,878,188 and 5,105,377 to Ziegler can be employed and those patents are hereby incorporated by reference into this specification. Also, a multi-input, multi-output control such as that in U.S. Pat. No. 5,091,953 hereby incorporated by reference herein, can be used to create global noise control. If the interaction between cells is small, then a single input/-single output controller can be used. Additionally, an adaptive feed-forward controller such as that described in Swinbanks (U.S. Pat. No. 4,423,289) and Ross (U.S. Pat. No. 4,480,333) patents.

Having described the invention, it will be obvious to those of ordinary skill in the art that changes and modifications can be made to the invention without departing from the scope of the appended claims.

We claim:

1. An active high transmission loss panel for use in quieting broadband sound radiation, said panel comprising panel means providing passive sound attenuation, said panel means including a plurality of first and second partition or partitioning means, with said panel means defining a number of contiguous cell means and being spaced from each other along the sound radiation path, each first said partition means having a first sensor means thereon and each said corresponding second partition means having a first actuator and second sensor means thereon, said actuator and sensor means, in conjunction with an active noise control means, adapted to attenuate noise impacting on said panel means from passing through to the opposite side.

2. A panel as in claim 1 wherein said first and second partition means, define, in conjunction with other partitions means, the said cell means and including a second sensor means and second actuator means on said other partition means adapted to, in conjunction with a multi-input/multi-output controller means to attenuate noise transmission in two opposite directions.

3. A panel as in claim 1 wherein said cell means have a height and width which correspond to $\frac{1}{4}$ to less than $\frac{1}{3}$ of the wavelength of the highest frequency to be actively controlled.

4. A panel as in claim 3 wherein said cell means height and width are essentially equal.

5. A panel as in claim 3 wherein said cell means have a depth which is smaller than the height or width so that the wave propagation through the cell means is planar.

6. An active high transmission loss system for attenuating broadband noise radiation, said system comprising a panel means providing passive sound attenuation, said panel means consisting of a plurality of contiguous cell means, sensor means located in each cell means, actuator means located in each cell means, said sensor means and actuator means being spaced one from the other is said cell means in the direction of noise radiation, controller means operatively connected to said sensor and actuator means and adapted to attenuate noise impinging on said panel means.

7. A system as in claim 6 wherein said panel means includes a first series of partition means, and a second series of partition means, said first and second series of partition means defining said cell means.

8. A system as in claim 7 wherein each cell means has multiple sensor and actuator means therein and said controller means is adapted to attenuate noise impinging on either side of the panel.

9. A system as in claim 6 wherein the cross-sectional dimensions of said cell means correspond to $\frac{1}{4}$ to less than $\frac{1}{3}$ of the wavelength of the highest frequency to be attenuated.

10. A system as in claim 9 wherein the depth of each cell means is smaller than the cross-sectional dimensions thereof so as to insure that the noise wave propagation through said cell means is planar.

11. An active high transmission loss panel for use in quieting broadband sound radiation, said panel comprising panel means providing passive sound attenuation and comprising a multiplicity of first and second spaced partition means which define a corresponding number of contiguous cell means, each said first partition means having a first sensor means thereon and each said corresponding second partition means having a first actuator means thereon and a second sensor means thereon, said first sensor means being spaced from said second sensor means, said actuator and sensor means, in conjunction with an active noise control means, adapted to attenuate noise impacting on said panel means from passing through from one side to the opposite side.

12. An active high transmission loss panel as in claim 11 and including a second actuator means on said first partition means so as to allow attenuation of noise transmission in either direction through said panel.

13. A panel as in claim 11 and including an active noise controller means, said controller adapted to control each cell means actuator independently.

14. A panel as in claim 11 and including an active noise controller means, said controller means adapted to control said actuators in said cell means interactively.

15. A panel as in claim 11 the dimensions of said partition means is from one tenth to less than one third of the wavelength of the highest order mode being controlled.

16. A panel as in claim 11 wherein said cell means are hollows.

17. A panel as in claim 11 wherein said cell means are constructed of passive materials.

* * * * *